US006234771B1

(12) United States Patent
Carey et al.

(10) Patent No.: US 6,234,771 B1
(45) Date of Patent: May 22, 2001

(54) PRECISION PUMPING DEVICE

(75) Inventors: Glen A. Carey, Grafton; William R. Downing, Elyria; David J. Lapeus, Medina; Randi L. Richey, Wellington; Mary Beth Whitesel, Grafton, all of OH (US)

(73) Assignee: Bayer Corporation, Tarrytown, NY (US)

( * ) Notice: Subject to any disclaimer, the term of this patent is extended or adjusted under 35 U.S.C. 154(b) by 0 days.

(21) Appl. No.: 09/322,354

(22) Filed: May 28, 1999

Related U.S. Application Data

(60) Provisional application No. 60/087,718, filed on Jun. 2, 1998.

(51) Int. Cl.[7] ..... F04B 17/00
(52) U.S. Cl. ..... 417/415; 417/360
(58) Field of Search ..... 417/360, 212, 417/415

(56) References Cited

U.S. PATENT DOCUMENTS

| | | | | |
|---|---|---|---|---|
| 1,695,305 | | 12/1928 | Upton | 92/13.6 |
| 3,036,529 | | 5/1962 | Archer | 103/168 |
| 3,155,041 | | 11/1964 | Green | 103/37 |
| 3,447,479 | * | 6/1969 | Rosenberg | 103/153 |
| 3,556,679 | * | 1/1971 | Middlebusher et al. | 417/63 |
| 4,089,624 | | 5/1978 | Nichols et al. | 417/362 |
| 4,276,003 | * | 6/1981 | Perkins et al. | 417/415 |
| 4,566,868 | | 1/1986 | Menzies | 417/572 |
| 4,715,791 | | 12/1987 | Berlin et al. | 417/274 |
| 4,793,776 | * | 12/1988 | Thistle et al. | 417/360 |
| 4,799,866 | * | 1/1989 | Faeser et al. | 417/415 |
| 4,922,900 | * | 5/1990 | Kiske et al. | 128/202.27 |
| 4,941,808 | * | 7/1990 | Qureshi et al. | 417/415 |
| 5,201,851 | * | 4/1993 | Holmstrom | 417/415 |
| 5,312,233 | * | 5/1994 | Tanny et al. | 417/316 |
| 5,540,562 | | 7/1996 | Giter | 417/254 |
| 5,567,122 | * | 10/1996 | Schulte | 417/214 |

FOREIGN PATENT DOCUMENTS

| | | | |
|---|---|---|---|
| 2053724A | 2/1981 | (GB) | B01D/13/00 |

OTHER PUBLICATIONS

Sanwa Tsusho Co., Ltd., Tokyo, Japan, Micro Pumps OEM Models, Jun. 16, 1998.

* cited by examiner

*Primary Examiner*—Timothy S. Thorpe
*Assistant Examiner*—Timothy P Solak
(74) *Attorney, Agent, or Firm*—Weingarten, Schurgin, Gagnebin & Hayes LLP

(57) ABSTRACT

A precision pumping device for aspirating and dispensing different volumes of fluid is presented. The precision pumping device comprises a housing with integral anti-rotation guides, a stepper motor which drives a fine pitch lead screw, a coupling for linking the piston to the leadscrew, an anti-backlash leadscrew follower, a split hub clamp nut, and a nut for securing the chamber to the housing. A seal is provided which seals around the piston and against the chamber, as is an o-ring that is set into a groove in the chamber and seals against a flange of the seal. The precision pumping device further includes a piston and a chamber for receiving at least a portion of the piston therein. The piston and chamber are of different sizes for aspirating and dispensing different volumes of fluid. The chamber can include a single port or multiple ports. Due to the self-aligning features and the reduced number of parts, the pump can be easily changed from aspirating and dispensing a first volume of fluid to aspirating and dispensing a second volume of fluid.

11 Claims, 10 Drawing Sheets

PRECISION PUMPING DEVICE

RELATED APPLICATIONS

This application claims priority under 35 U.S.C. § 119(e) to provisional patent application Ser. No. 60/087,718, filed Jun. 2, 1998, the disclosure of which is hereby incorporated by reference.

STATEMENT OF FEDERALLY SPONSORED RESEARCH

Not Applicable

BACKGROUND OF THE INVENTION

Pumps are used to dispense and aspirate fluids. When it is desirable to repeatedly dispense and/or aspirate small quantities of fluid, the pump must be made to provide precise dispensing and aspirating operations. Pumps typically comprise many pieces, which make the pump difficult to manufacture and assemble. Additionally, the multiple pieces have varying tolerances that affect the accuracy and precision of the pump.

Sanwa Tsusho Co., LTD. Tokyo, Japan produces a micro pump. The pump of Sanwa Tsusho Co., LTD. has a piston seal that includes a washing port, does not include an anti-backlash follower and does not include a manual adjustment for changing the position of the piston within the pump.

It would be desirable to have a precision pump which includes a minimal amount of parts, which is simple to manufacture and assemble, and which provides a high degree of accuracy for a large number of aspirating and/or dispensing operations.

SUMMARY OF THE INVENTION

A precision pumping device for aspirating and dispensing different volumes of fluid is presented. The precision pumping device comprises a housing with integral anti-rotation guides, a stepper motor which drives a fine pitch lead screw, a coupling for linking the piston to the leadscrew, an anti-backlash leadscrew follower, a split hub clamp nut, and a nut for securing the chamber to the housing. A seal is provided which seals around the piston and against the chamber, as is an o-ring that is set into a groove in the chamber and seals against a flange of the seal. A piston is driven into and out of a cooperating chamber to provide aspirating and dispensing of fluids. By way of the anti-rotation guides, the fine pitch leadscrew, the anti-backlash leadscrew follower, and other parts of the pump, precise volumes of fluid are aspirated and dispensed. The precision pumping device may further include sets of cooperating pistons and chambers of different sizes for aspirating and dispensing different volumes of fluid. The chamber can include a single port or multiple ports. Due to the self-aligning features and the reduced number of parts, the pump can be easily changed from precisely aspirating and dispensing a first volume of fluid to precisely aspirating and dispensing a second volume of fluid.

BRIEF DESCRIPTION OF THE DRAWINGS

The invention will be better understood by referring to the detailed description taken in conjunction with the following drawings, in which.

DETAILED DESCRIPTION OF THE INVENTION

Figure 1:
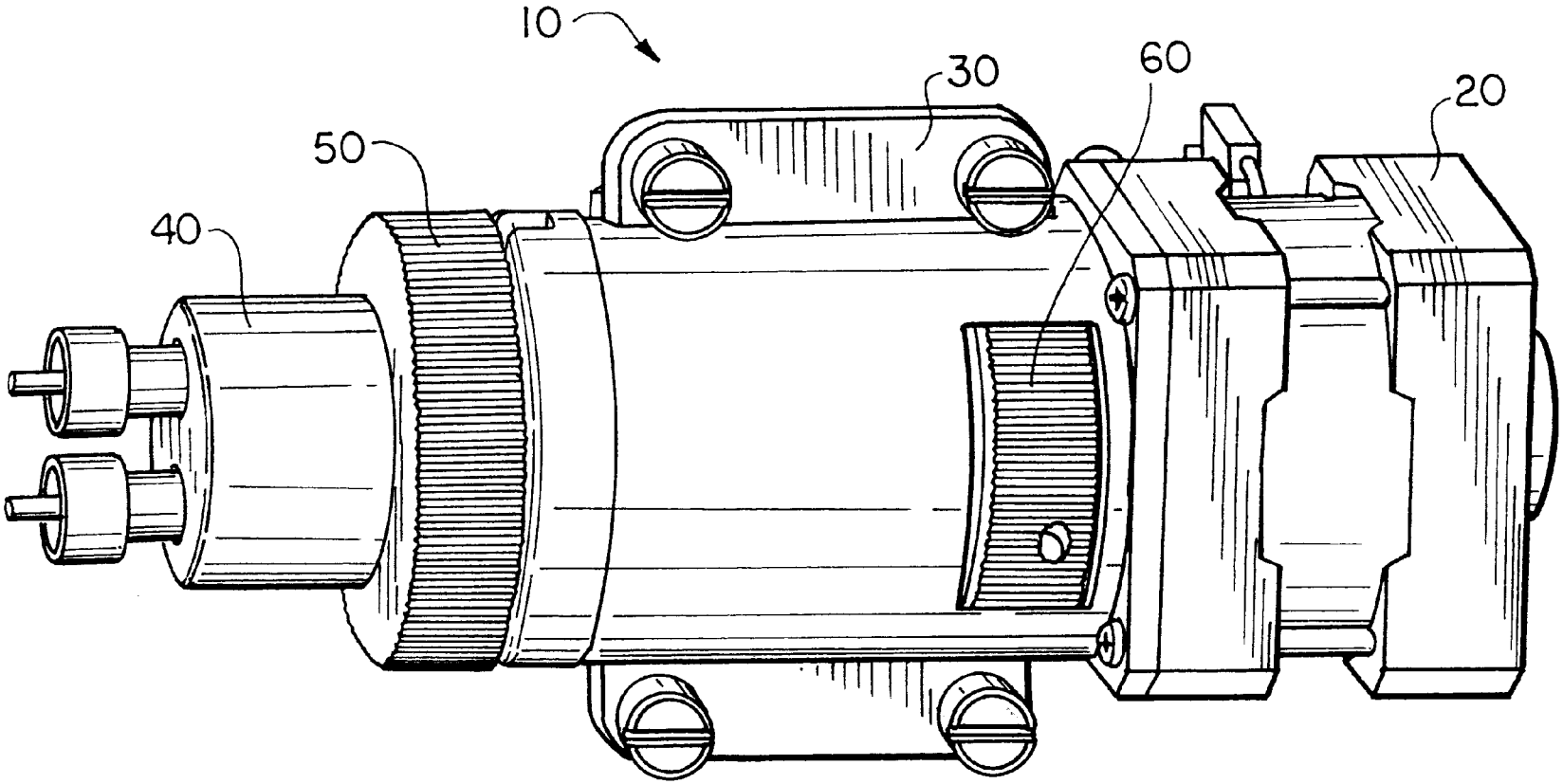
FIG. 1 is a view of the precision pumping device of the present invention.

Referring to FIG. 1, a precision pumping device 10 for accurately aspirating and dispensing different volumes of liquid or gas is shown. The precision pumping device 10 includes a housing 30 having integral anti-rotation guides, a stepper motor 20, a chamber 40, a nut 50 for securing the chamber 40 to the housing 30, and a split hub clamp nut 60 for manual positioning of an internal piston within the housing 30 and chamber 40.

Figure 2:
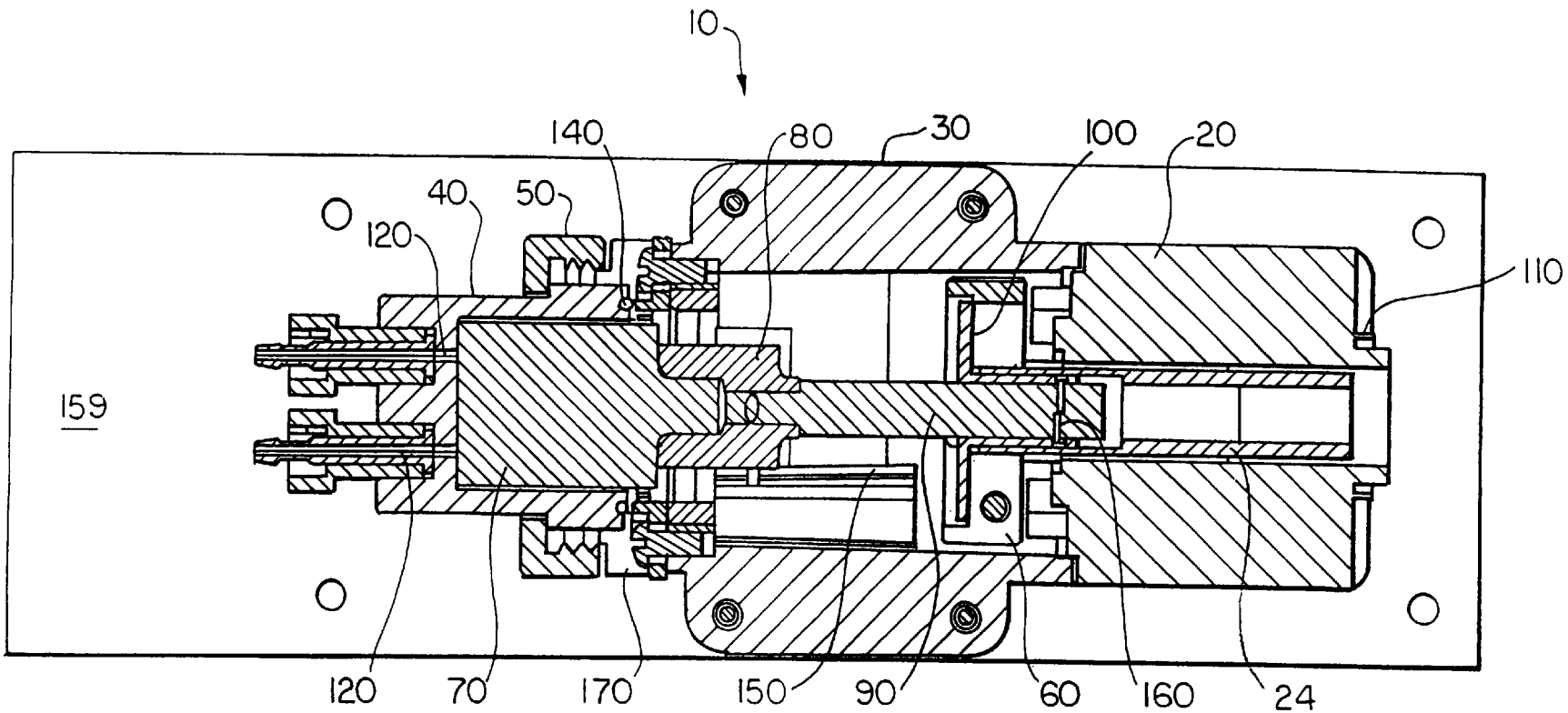
FIG. 2 is a cross-sectional side view of the precision pump of FIG. 1.

Shown in FIG. 2 is a top cross-sectional view of the precision pumping device 10. In this figure the internal pieces of the pump 10 are shown. The stepper motor 20 drives a fine pitch leadscrew 90 that attaches to a first end of coupling 80. The opposite end of coupling 80 attaches to piston 70, such that the piston 70 is moveable by actuation of motor 20. The leadscrew 90 also has an anti-backlash leadscrew follower 100 and a spring 160.

Also shown in FIG. 2 is an end play lock nut 110 at one end of motor 20 as well as a seal 170 which is positioned between the nut 50 and the housing 30. Seal 170 includes an o-ring 140 positioned between the chamber 40 and the seal 170. Chamber 40 is shown here having multiple ports 120.

Figure 3A:
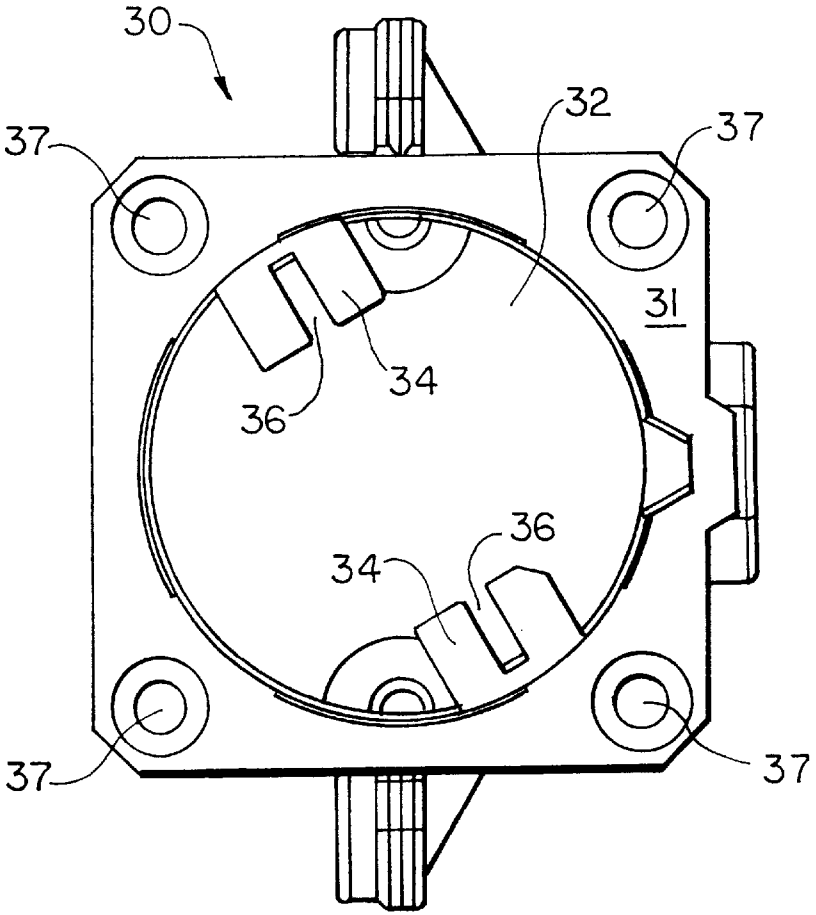
FIG. 3A is a top view of the housing of the precision pump of FIG. 1.
Figure 3B:
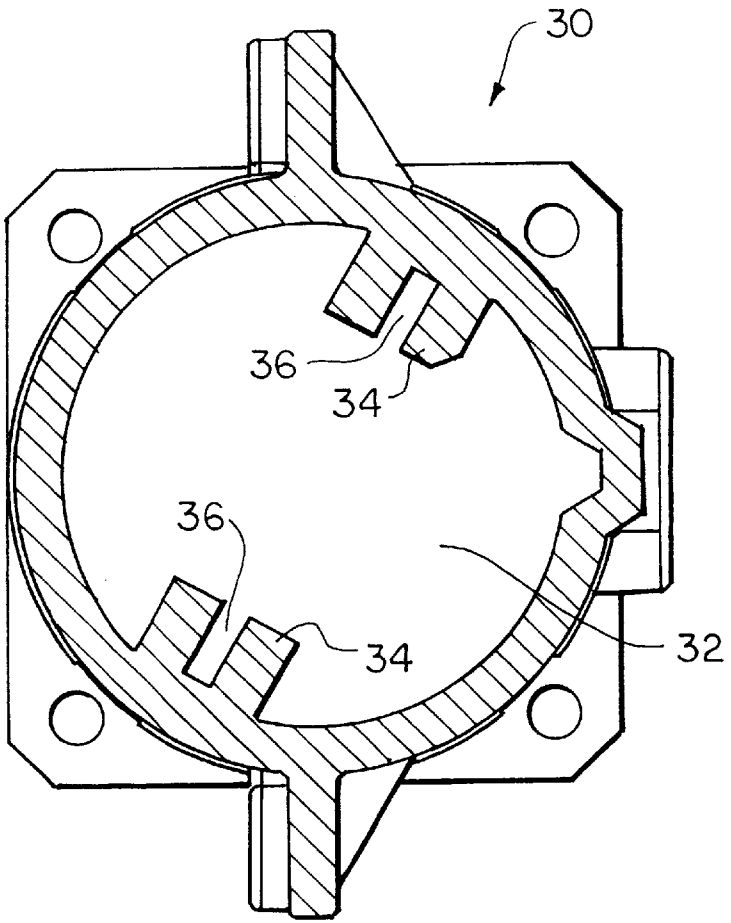
FIG. 3B is a cross-sectional top view of the housing of FIG. 3A.
Figure 4B:
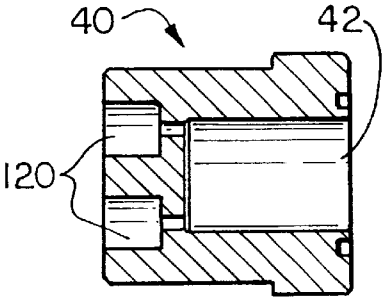
FIG. 4B is a cross-sectional side view of the first chamber of FIG. 4A.
Figure 4D:
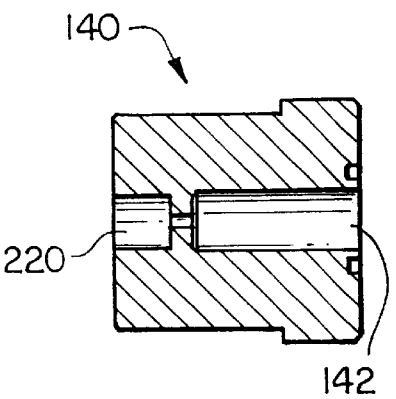
FIG. 4D is a cross-sectional side view of the second chamber of FIG. 4C.
Figure 4A:
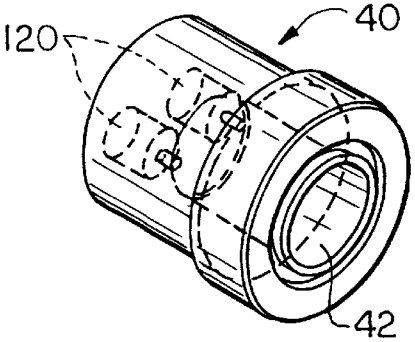
FIG. 4A is a perspective view of a first chamber.
Figure 4C:
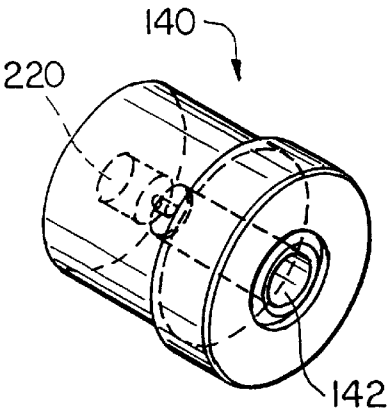
FIG. 4C is a perspective view of a second chamber.
Figure 3C:
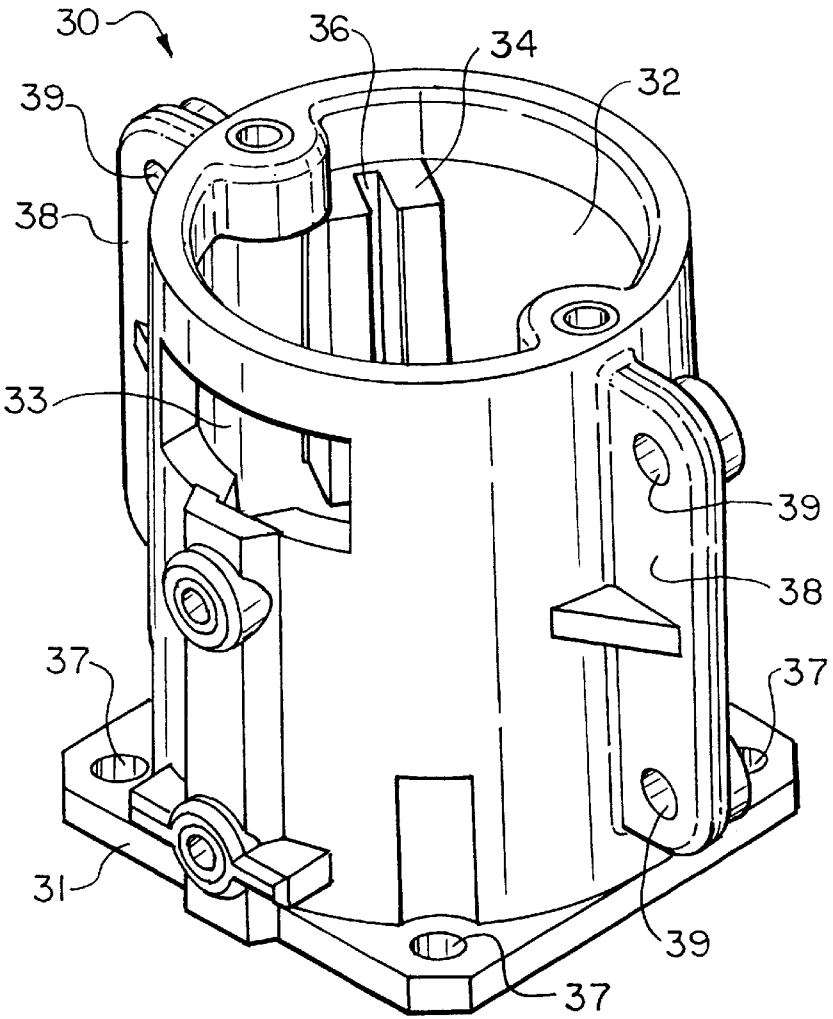
FIG. 3C is a perspective view of the housing of FIG. 3A.
Figure 4F:
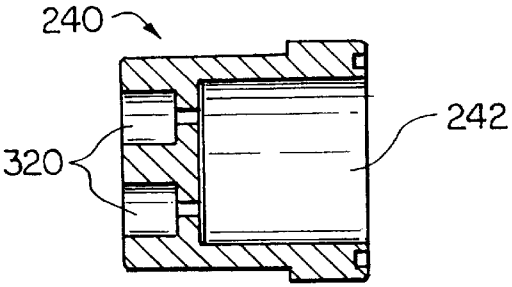
FIG. 4F is a cross-sectional side view of the third chamber of FIG. 4E.

Referring now to FIGS. 3A–3C, housing 30 is shown. Housing 30 includes a central bore 32. Disposed within the central bore 32 and integral with housing 30 is a pair of anti-rotation guides 34. The anti-rotation guides 34 include a slotted opening 36 which receives a pin extending through the coupling 80, and prevent the coupling 80 from rotating within the housing 30. Housing 30 further includes a base portion 31 that contains a plurality of holes 37 for attaching the motor to the housing 30. Housing 30 further includes a pair of mounting flanges 38 including mounting holes 39 for attaching the housing 30 to a support. Additionally, housing 30 includes a side opening 33 through which manual adjustment of the piston position is accomplished by rotating a split hub clamp nut, described in detail below. The housing and integral anti-rotation guides are manufactured from a wear resistant material such as LEXAN with TEFLON filler.

Shown in FIGS. 4A–4F are chambers 40, 140 and 240. Each chamber has a substantially cylindrical shape and includes a respective cylindrical bore 42, 142 and 242 extending a predetermined distance within the chamber for receiving a cooperating piston therein. Each respective cylindrical bore is configured, along with its respective cooperating piston, to provide for the aspirating and/or dispensing of different predetermined quantities of fluid. The chambers also include at least one port 120, 220, 320 extending from an end into the central bore, and allowing the central bore to be in fluid communication from within the chamber to external the chamber. Each chamber can include a single port or multiple ports 120, 220, 320. A manifold may be utilized in place of the chamber, wherein the manifold receives the piston and is sealed against the flange of the seal which surrounds the piston.

Figure 5C:
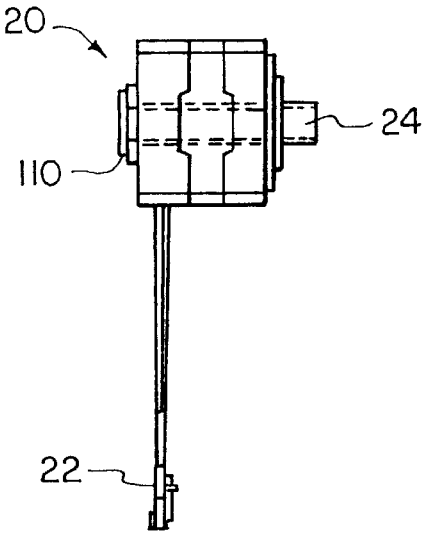
FIG. 5C is a side view of the motor of FIG. 5A.
Figure 5B:
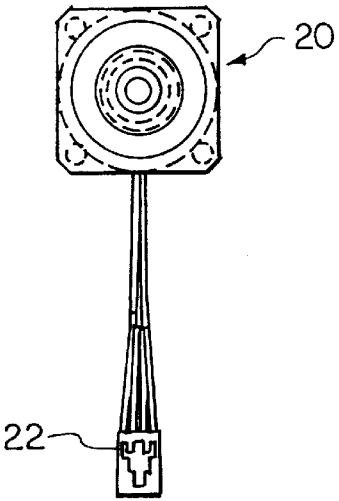
FIG. 5B is a frontal view of the motor of FIG. 5A.
Figure 4E:
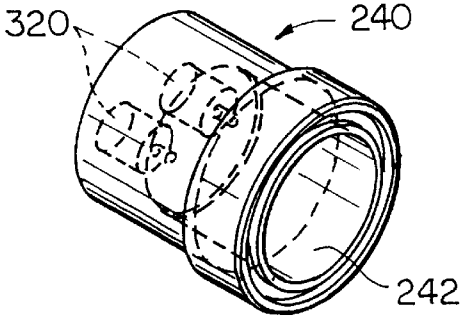
FIG. 4E is a perspective view of a third chamber.
Figure 5A:
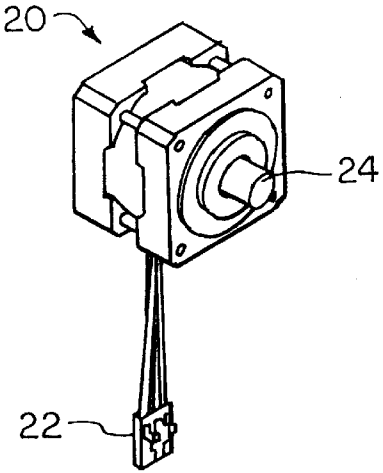
FIG. 5A is a perspective view of a motor.

Referring now to FIGS. 5A–5C, motor 20 is shown. Motor 20 includes a power harness 22 that provides power to the motor and drives the rotor 24. Rotor 24 also includes an end play locknut 110 that is adjustable to remove any backlash between the fine pitch leadscrew and the motor 20. As the locknut 110 is tightened against the stepper motor 20, pressure is exerted on the rotor 24, thus eliminating the opportunity for the rotor 24 to slide within the motor 20 when the direction of rotation of the motor 20 is reversed.

Figure 6C:
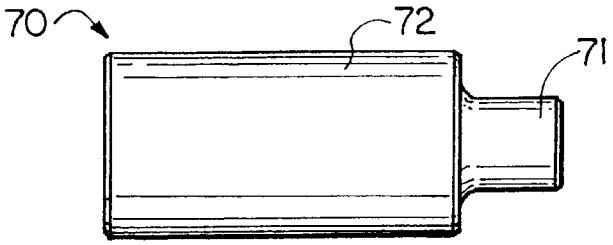
FIG. 6C is a side view of the first piston of FIG. 6A.
Figure 6B:
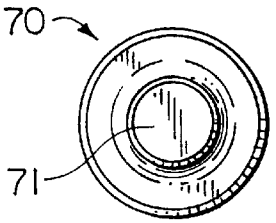
FIG. 6B is an end view of the first piston of FIG. 6A.
Figure 6A:
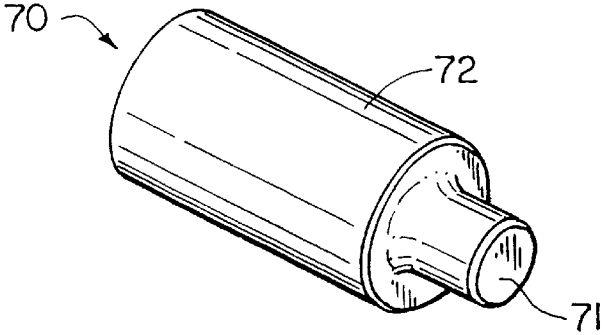
FIG. 6A is a perspective view of a first piston.
Figure 6F:
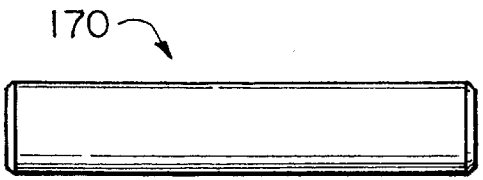
FIG. 6F is a side view of the second piston of FIG. 6D.
Figure 6E:
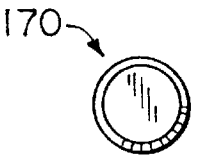
FIG. 6E is an end view of the second piston of FIG. 6D.
Figure 6D:
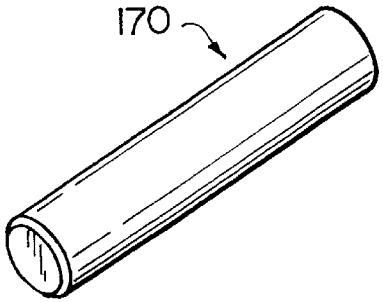
FIG. 6D is a perspective view of a second piston.
Figure 6I:
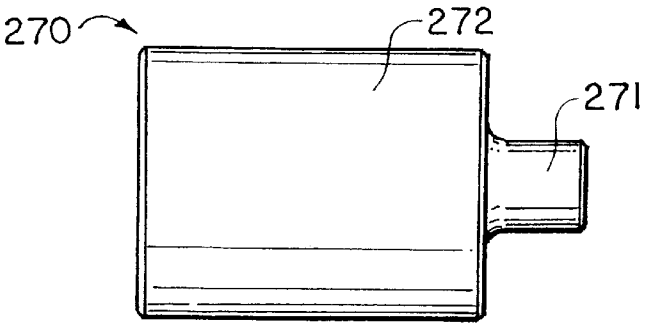
FIG. 6I is a side view of the third piston of FIG. 6G.
Figure 6H:
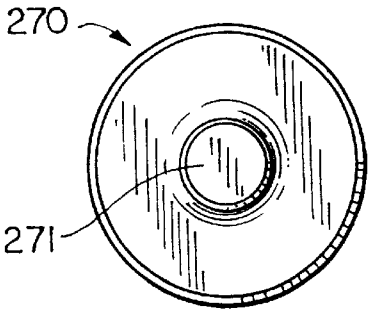
FIG. 6H is an end view of the third piston of FIG. 6G.
Figure 6G:
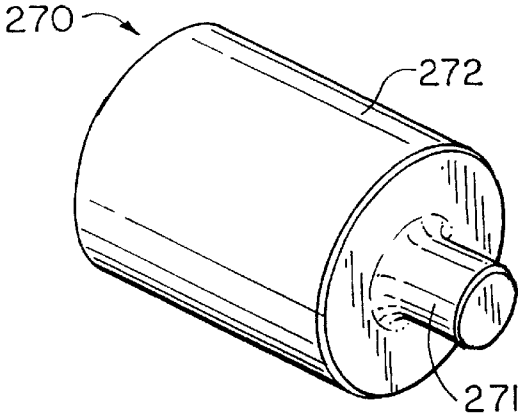
FIG. 6G is a perspective view of a third piston.

Referring now to FIGS. 6A–6I, three different sized pistons are shown. FIGS. 6A–6C show first piston 70. Piston 70 includes two differently sized sections. A first section 71 is adapted to be received by the coupling 80 and secured thereto by interference fit, chemical bonding, mechanical bonding (e.g. pinning), or cooperating threading. The second section 72 is sized to be received inside a cooperating chamber and to be movable within the chamber for dispensing or aspirating a first volume of fluid. FIGS. 6D–6F show a second piston 170. Piston 170 has a substantially uniform size. A first section of piston 170 is installable within the coupling 80 and secured thereto by interference fit, chemical bonding, mechanical bonding (e.g. pinning), or cooperating threading. The second section of piston 170 is insertable within a cooperating chamber and provides for aspirating and dispensing a second volume of fluid which is smaller than the first volume of fluid. A third piston is shown in FIGS. 6G–6I. Third piston 270 also includes two differently sized sections. A first section 271 is adapted to be received by the coupling 80 and secured thereto by interference fit, chemical bonding, mechanical bonding (e.g. pinning), or cooperating threading. The second section 272 is sized to be received inside a cooperating chamber and to be movable within the chamber for dispensing or aspirating a third volume of fluid which is larger than the first volume of fluid. While each piston is shown having a single sized second section, the second section could be configured wherein the second section has a first part and a second part, the first part having a narrower diameter than the second part, resulting in a stepped piston.

Figure 7C:
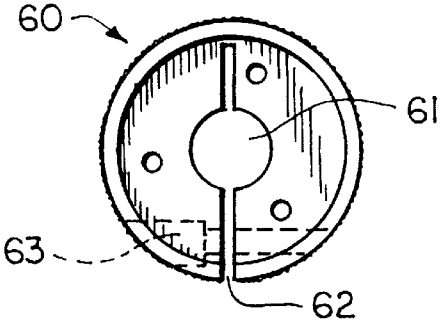
FIG. 7C is an end view of the split hub clamp nut of FIG. 7A.
Figure 7B:
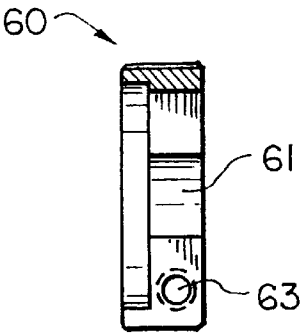
FIG. 7B is a cross-sectional side view of the split hub clamp nut of FIG. 7A.
Figure 7A:
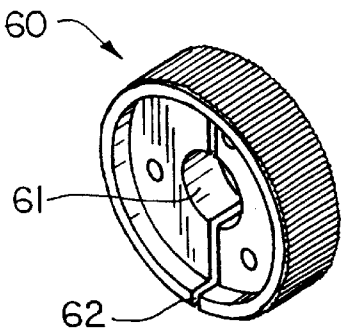
FIG. 7A is a perspective view of a split hub clamp nut.

FIGS. 7A–7C show a split hub clamp nut 60. Split hub clamp nut 60 includes a first central bore 61 and a slot 62 extending from bore 61 to an external surface of the split hub clamp nut 60. Split hub clamp nut 60 further includes a second bore 63 for receiving a locking screw therein. The split hub clamp nut 60 is installed surrounding a portion of the anti-backlash leadscrew follower and the leadscrew. Once the split hub clamp nut 60 is installed surrounding the anti-backlash leadscrew follower, a locking screw is installed within the bore 63 and tightened to secure the split hub clamp nut in place. The split hub clamp nut 60 is rotatable by a user via the side opening in the housing. The user can manually rotate the split hub clamp nut 60 and move the position of the piston to a desired location within the chamber.

Figure 8A:
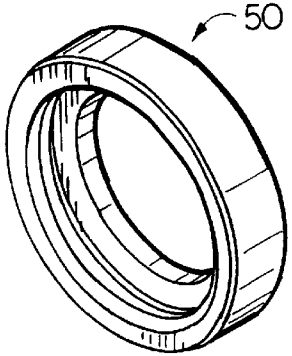
FIG. 8A is a perspective view of the nut.
Figure 8B:
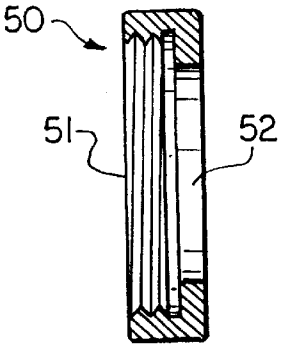
FIG. 8B is a cross-sectional side view of the nut of FIG. 8A.

Referring now to FIGS. 8A and 8B nut 50 is shown. Nut 50 is used to removably secure a chamber to the housing. Nut 50 includes a central bore 51 that is threaded and mates with a cooperating portion of the housing seal. Nut 50 also includes a second bore 52 that captures a portion of a chamber therein.

Figure 9E:
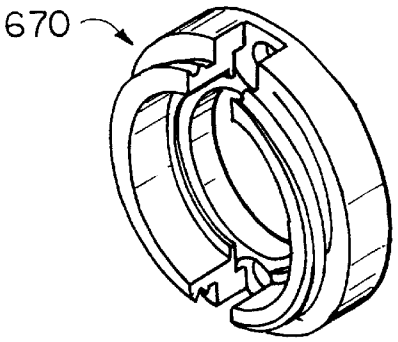
FIG. 9E is a perspective view of a third seal.
Figure 9C:
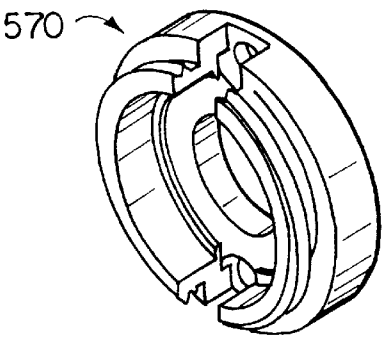
FIG. 9C is a perspective view of a second seal.
Figure 9A:
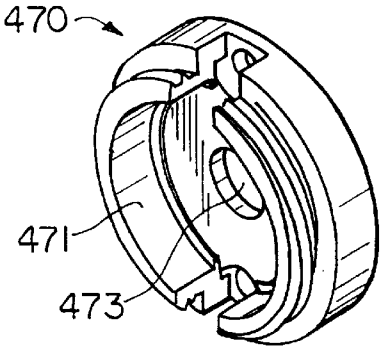
FIG. 9A is a perspective view of a first seal.
Figure 9F:
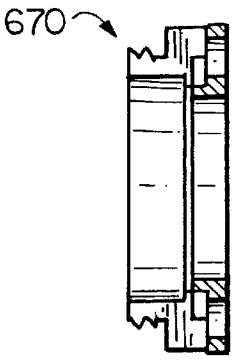
FIG. 9F is a cross-sectional side view of the seal of FIG. 9E.
Figure 9D:
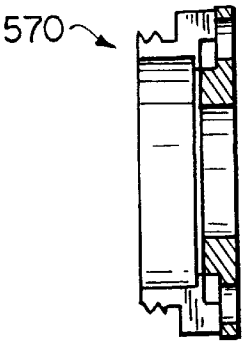
FIG. 9D is a cross-sectional side view of the seal of FIG. 9C.
Figure 9B:
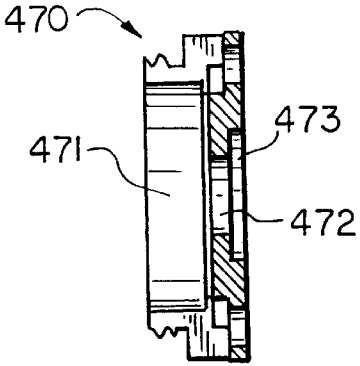
FIG. 9B is a cross-sectional side view of the seal of FIG. 9A.

Referring now to FIGS. 9A-9F three seals 470, 570 and 670 are shown. Each seal attaches to housing 30 at a first end and threadably receives nut 50 at a second end. Seal 470 includes a first bore 471 for receiving a portion of chamber 40 therein. A second bore 472 receives a portion of piston 170 therethrough. A third bore 473 receives a portion of coupling 80 therein. FIGS. 9C–9D show a seal 570. Seal 570 is similar to seal 470 except that the second bore is sized to receive piston 70 therethrough when piston 70 is used. Similarly, a third seal 670, shown in FIGS. 9E–9F, is similar to seal 470 except that second bore is sized to receive piston 270 therethrough when piston 270 is used.

Figure 10C:
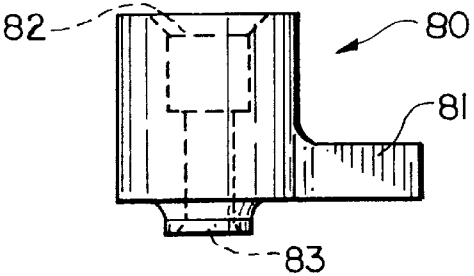
FIG. 10C is a side view of the coupling of FIG. 10A.
Figure 10B:
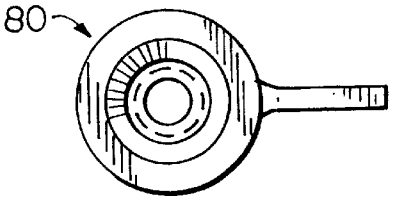
FIG. 10B is a top view of the coupling of FIG. 10A.
Figure 10A:
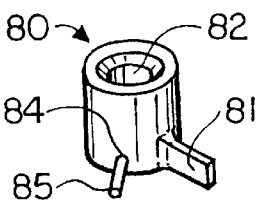
FIG. 10A is a perspective view of a coupling.

FIGS. 10A–10C show coupling 80. Coupling 80 includes a shutter 81 extending from an outside surface of coupling 80. Coupling 80 further includes a bore 84 for receiving a pin 85 therethrough. Pin 85 is received within the slotted openings 36 of each of the anti-rotation guides 34 of the housing 30. Pin 85 slides within the anti-rotation guides and prevents coupling 80 from rotating while the coupling is being driven forward and/or backward within the housing. Coupling 80 has a first central bore 82 extending partially within the coupling. First central bore 82 is sized to receive a portion of the piston therein. A second central bore 83 extends from an opposite end of the coupling as first central bore. Second central bore 83 receives a portion of the leadscrew 90 therein. Coupling 80 thus couples the leadscrew 90 to a piston.

Figure 11B:
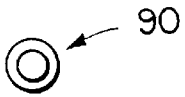
FIG. 11B is an end view of the leadscrew of FIG. 11A.
Figure 11A:
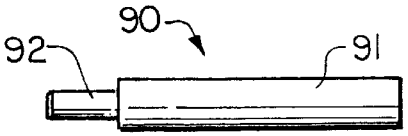
FIG. 11A is a side view of a leadscrew.

FIGS. 11A–11B show leadscrew 90. Leadscrew 90 has two sections, a first section 91 having a first diameter and a second section 92 having a narrower diameter than first section 91. First section 91 couples to the motor 20, while second section 92 is received within the coupling 80.

Figure 14:
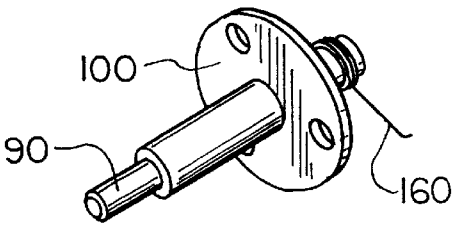
FIG. 14 is a perspective view of the leadscrew, follower and spring assembly.
Figure 12B:
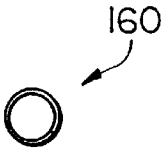
FIG. 12B is an end view of the spring of FIG. 12A.
Figure 12A:
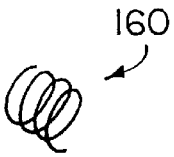
FIG. 12A is a side view of a spring.
Figure 13A:
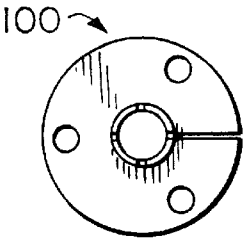
FIG. 13A is an end view of a follower.
Figure 13B:
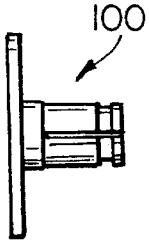
FIG. 13B is a side view of the follower of FIG. 13A.

FIGS. 12A and 12B show a spring 160 that is used as part of an anti-backlash leadscrew follower assembly. FIGS. 13A and 13B show anti-backlash leadscrew follower 100. FIG. 14 shows the anti-backlash leadscrew follower 100 installed on leadscrew 90 with spring 160. The anti-backlash follower 100 is self-aligning as it fits into a hollow portion of the shaft and is secured to the shaft, as well as being spring loaded by spring 160 to provide a biasing force against the leadscrew 90 to account for any tolerance differences with the leadscrew 90 and to account for dimensional changes as the leadscrew to follower nut junction wears.

Figure 15A:
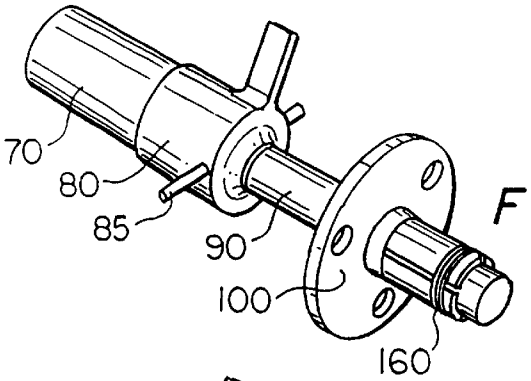
FIG. 15A is a perspective view of the first piston assembly.
Figure 15B:
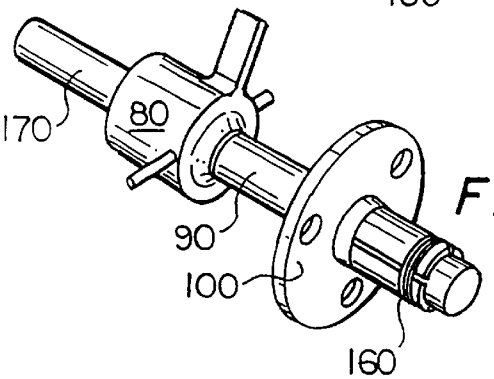
FIG. 15B is a perspective view of the second piston assembly.
Figure 15C:
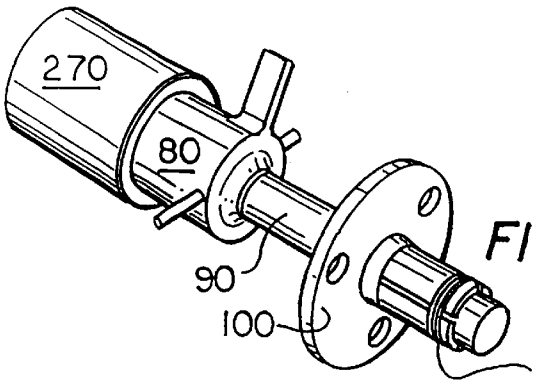
FIG. 15C is a perspective view of the third piston assembly.

FIGS. 15A–15C show assemblies wherein the leadscrew 90 has the anti-backlash leadscrew follower 100 and spring 160 installed. The leadscrew 90 is coupled to coupling 80, and coupling 80 is coupled to the piston 70, 170, 270.

Figure 16C:
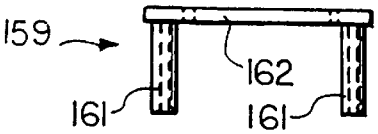
FIG. 16C is a side view of the mounting plate of FIG. 16A.
Figure 16B:
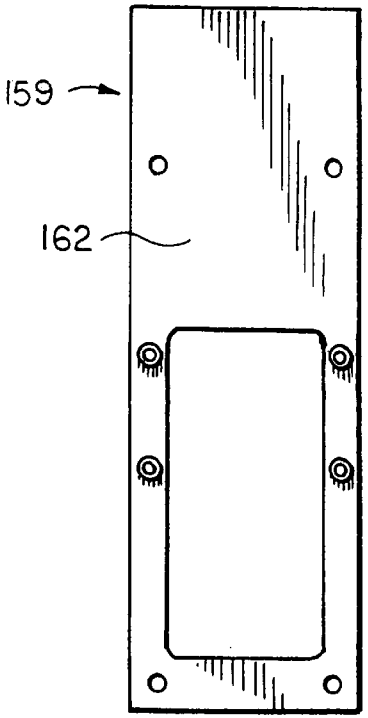
FIG. 16B is a top view of the mounting plate of FIG. 16A.
Figure 16A:
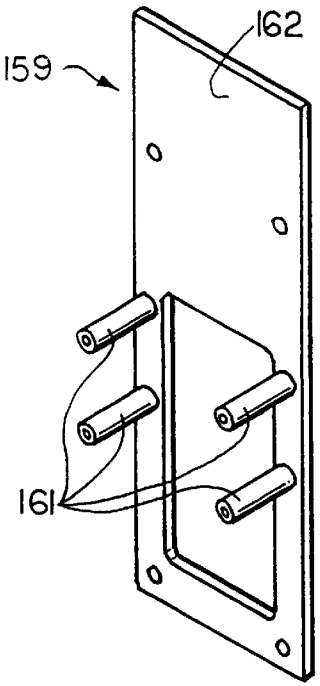
FIG. 16A is a perspective view of the mounting plate.

FIGS. 16A–16C show mounting plate 159. Mounting plate 159 comprises a base plate 162 and four mounting posts 161. The housing is secured to the posts 161 by screws or other fasteners that are received through mounting holes on the housing and into the posts 161.

The above described precision pump by way of the integral anti-rotation guides, anti-backlash leadscrew follower, the end play locknut of the stepper motor, and the fine pitch leadscrew coupled to the stepper motor, provides for accurate and reliable aspirating and dispensing of fluid. The inclusion of self-aligning parts and the reduction in the number of parts provides substantial cost savings in the manufacturing of the precision pump since assembly time and alignment time are minimized or eliminated. Further, the precision pump is easily changed to aspirate and/or dispense different volumes of fluid by removing a cooperating piston and chamber of a first size and installing a cooperating piston and chamber of second different size.

Having described preferred embodiments of the invention it will become apparent to those of reasonable skill in the art that other embodiments incorporating the above described features may also be developed. Accordingly, it is submitted that the present invention not be limited to the described embodiments but rather by the scope and spirit of the appended claims.

We claim:

1. A precision pumping device comprising:

a housing including an integral anti-rotation guide;

a first chamber removably coupled to said housing;

a first piston displaceable within a portion of said chamber, said first piston and said first chamber adapted to aspirate or dispense a first volume of fluid;

a port disposed within said chamber, said port providing fluid communication from within said chamber to outside of said chamber;

a fine pitch lead screw;

a coupling fixedly linking said piston to said leadscrew;

an anti-rotation member projecting from said coupling and into said anti-rotation guide;

a split hub clamp nut coupled to said leadscrew; and a stepper motor attached to said housing, said stepper motor coupled to said leadscrew and operative to move said leadscrew in a first direction for moving said piston within said chamber to dispense a first volume of fluid within said chamber out of said port, said stepper motor operative to move said leadscrew in a second direction for moving said piston within said chamber to aspirate a first volume of fluid into said chamber through said port.

2. The precision pumping device of claim 1 further comprising an anti-backlash leadscrew follower coupled to said leadscrew.

3. The precision pumping device of claim 2 wherein said anti-backlash leadscrew follower is self-aligning.

4. The precision pumping device of claim 2 wherein said anti-backlash leadscrew further comprises a spring providing a biasing force between said leadscrew and said coupling.

5. The precision pumping device of claim 1 further comprising a seal disposed around said piston and against a surface of said chamber.

6. The precision pumping device of claim 5 further comprising an o-ring disposed within said chamber and against a flange of said seal.

7. The precision pumping device of claim 1 further comprising an end play lock nut disposed on an end of said stepper motor.

8. The precision pumping device of claim 1 further comprising a nut removably coupling said chamber to said housing.

9. The precision pumping device of claim 1 further comprising at least one additional port disposed in said chamber.

10. The precision pumping device of claim 1 wherein said housing comprises LEXAN having TEFLON filler.

11. The precision pumping device of claim 1 further comprising:

a second piston having a different size than the first piston, said second piston substitutable for said first piston; and a second chamber having a different size than said first chamber, said second chamber substitutable for said first chamber, said second piston and said second chamber adapted to dispense or aspirate a second volume of liquid.

* * * * *